US007308981B1

(12) United States Patent
Noel Du Payrat et al.

(10) Patent No.: US 7,308,981 B1
(45) Date of Patent: Dec. 18, 2007

(54) CONTAINER FOR AMMUNITION

(75) Inventors: Jean-François Noel Du Payrat, Nantes (FR); Elsa Jukiw, Nantes (FR); Stéphane Guibert, Viellevigne (FR)

(73) Assignee: Giat Industries, Versailles (FR)

( * ) Notice: Subject to any disclaimer, the term of this patent is extended or adjusted under 35 U.S.C. 154(b) by 422 days.

(21) Appl. No.: 11/150,323

(22) Filed: Jun. 13, 2005

(30) Foreign Application Priority Data

Jun. 25, 2004 (FR) ..... 04 07109

(51) Int. Cl.
*F24B 39/00* (2006.01)

(52) U.S. Cl. ..... 206/3; 206/317

(58) Field of Classification Search ..... 206/3, 206/317, 446, 1.5, 521, 591, 592, 594
See application file for complete search history.

(56) References Cited

U.S. PATENT DOCUMENTS 5,097,945 A * 3/1992 Brooks ..... 206/3
5,779,031 A 7/1998 Moraine et al. ..... 206/3
6,357,582 B1 3/2002 Fischer ..... 206/3
6,827,206 B2 * 12/2004 Brase et al. ..... 206/3

FOREIGN PATENT DOCUMENTS

| | | |
|---|---|---|
| DE | 100 61 068 | 6/2002 |
| EP | 0 945 701 | 9/1999 |
| EP | 0 945 702 | 9/1999 |
| EP | 1 101 077 | 5/2001 |
| FR | 2 724 718 | 3/1996 |

* cited by examiner

*Primary Examiner*—Jacob K. Ackun, Jr.
(74) *Attorney, Agent, or Firm*—Steptoe & Johnson LLP

(57) ABSTRACT

A container for ammunition of the type comprising a case inside which an inner casing receiving the ammunition is able to slide between two axial positions, one in which it blocks the ammunition and the other in which it unblocks the ammunition, the inner casing incorporating a front sleeve having flexible fingers, such sleeve cooperating in its blocking position with a fixed limit stop integral with the case and ensuring the retention of the fingers on a zone of the projectile to limit its translation, such container wherein it incorporates means ensuring the radial spacing of the flexible fingers at a distance from the projectile in the unblocking position of the inner casing.

10 Claims, 5 Drawing Sheets

CONTAINER FOR AMMUNITION

BACKGROUND OF THE INVENTION

1. Field of Invention

The technical scope of the invention is that of ammunition transportation containers and namely containers enabling the blocking of explosive ammunition.

2. Description of the Related Art

A container is known, namely by patent EP1101077 that comprises an inner casing able to be moved from a blocking position to an unblocking position. This inner casing incorporates a front part comprising flexible tongues that press on the front pocket of a fin-stabilized projectile.

In the blocked position, the tongues are held radially by a fixed case. In the unblocked position, traction on the ammunition radially deforms the tongues allowing the ammunition to be extracted from the container.

When the container falls on its closing lid, the ammunition is held in place by tongues that are not able to deform radially thanks to the case.

Such a container is well adapted to the retention of fin-stabilized ammunition whose projectile incorporates a front pocket whose substantially conical profile enables the tongues to be deformed and which enables the ammunition to be extracted.

It is, however, unsuitable for the blocking of ammunition equipped with a shaped charge explosive projectile that does not incorporate such a front pocket.

Common explosive projectiles have a bottle-shaped profile incorporating a substantially calibred body extended by a sub-calibred neck tipped by an impact switch.

The only abutment surface available for such a projectile is a flange ring generally placed alongside the impact switch. But such an abutment surface is perpendicular to the ammunition's axis and is not able to ensure the spacing of the retention fingers. This results in a risk of the ammunition being stuck in the container preventing its subsequent removal.

SUMMARY OF THE INVENTION

The aim of the invention is to propose a container that overcomes such drawbacks.

Thus, the container according to the invention efficiently blocks the ammunition whatever the profile of the available bearing surface on the projectile body.

The invention thus relates to a container for ammunition of the type comprising a case inside which an inner casing receiving the ammunition is able to slide between two axial positions, one in which it blocks the ammunition and the other in which it unblocks the ammunition, the inner casing incorporating a front sleeve having flexible fingers, such sleeve cooperating in its blocking position with a fixed limit stop integral with the case and ensuring the retention of the fingers on a zone of the projectile to limit its translation, such container wherein it incorporates means ensuring the radial spacing of the flexible fingers at a distance from the projectile in the unblocking position of the inner casing.

According to a particular embodiment, the means ensuring the radial spacing of the fingers may comprise a cylinder coaxial to the inner casing and integral with the fixed limit stop.

The fixed limit stop may incorporate a conical profile cooperating, in the blocking position, with a matching profile on the sleeve's fingers.

According to a particular embodiment, the fixed limit stop may comprise a conical portion connected to the coaxial cylinder by at least one radial rib.

The sleeve will, in this case, incorporate slots separating the fingers, such slots intended to receive the ribs on the fixed limit stop.

The fixed limit stop may be integral with a shim made of a compressible material fixed to the case.

The shim of compressible material may advantageously incorporate a conical profile extending that of the limit stop.

The sleeve of the inner casing will surround one front part of the projectile, an inner surface of the sleeve forming a support for the ammunition body.

The sleeve may be globally conical in shape surrounding a front part of the projectile, such sleeve extended by a seat fastened to the inner casing.

The container may incorporate at least one cylindrical shim integral with the inner casing, such shim intended to be placed between said casing and the ammunition.

BRIEF DESCRIPTION OF THE DRAWINGS

The invention will become more apparent from the following description of a particular embodiment, such description being made with reference to the appended drawings, in which.

DETAILED DESCRIPTION OF PREFERRED EMBODIMENTS

Figure 1:
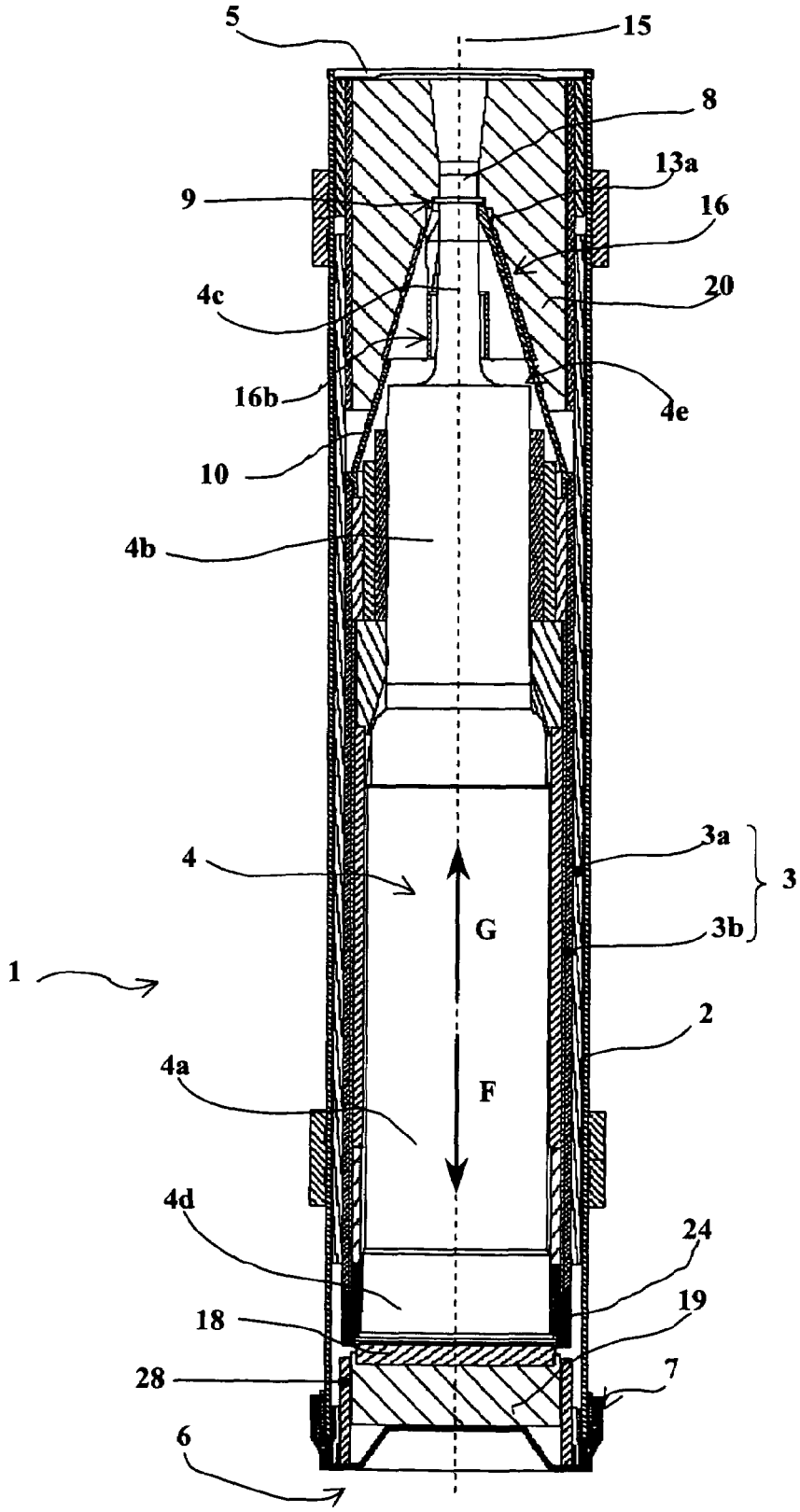
FIG. 1 shows a longitudinal section of a container according to the invention enclosing a piece of ammunition, such container being shown in the blocking position.

With reference to FIG. 1, a container 1 according to the invention comprises a case 2 inside which an inner casing 3 enclosing ammunition 4 is able to slide.

The case 2 of the container is generally cylindrical in shape. It is advantageously made of cardboard and is closed off at one end by a crimped metallic bottom 5.

The case is closed at its other end for example by a threaded link 7.

Here the ammunition 4 is explosive tank ammunition. It comprises a combustible case 4*a* integral with a base 4*d* and a shaped charge projectile 4*b* incorporating a sub-calibred nose 4*c* tipped by an impact switch 8 fitted with a flange ring 9.

The inner casing 3 incorporates a cylindrical body formed of two coaxial cardboard tubes 3*a* and 3*b*, such body being mounted able to slide inside the case 2. Cylindrical shims 23*a*, 23*b*, 23*c*, 23*d* (see FIG. 2) are placed between the ammunition 4 and the casing 3. These shims improve the retention of the ammunition and ensure that the radial shocks are absorbed.

The inner tube 3*b* has a collar 24 made of a plastic material that is in contact with a circular rim of the base 4*d*.

In accordance with the invention, the inner casing 3 also incorporates a front sleeve 10 of a globally conical shape. This sleeve surrounds the nose 4*c* of the ammunition 4 and part of the front of the body 4*b* of the ammunition 4.

Figure 5:
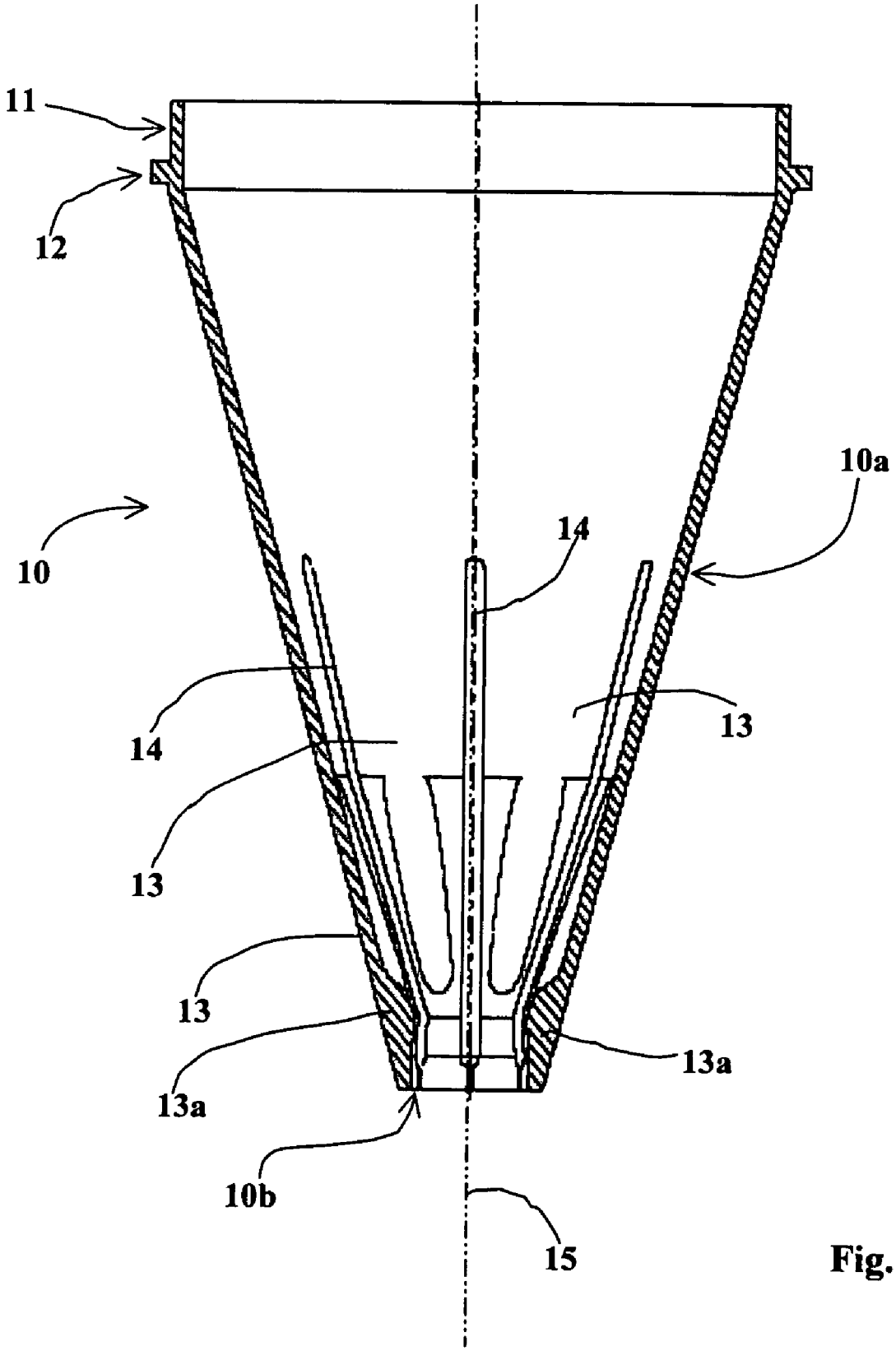
FIG. 5 is a longitudinal section of the sleeve alone.

FIG. 5 shows this sleeve 10 alone. It is made of a plastic material and incorporates a rear cylindrical part 11 that is fixed, for example by bonding to the inner tube 3*b* of the casing 3. A shoulder 12 separates the conical part and the cylindrical seat of the sleeve 10. This shoulder acts as a mechanical limit stop when the sleeve 10 is mounted onto the body of the inner casing 3. The shoulder 12 enables the mechanical compressive stresses to be transmitted between the sleeve 10 and the tubes 3*a* and 3*b* of the casing 3 (tubes being assembled, for example, by stapling).

As may be seen in FIG. 5, the sleeve 10 has flexible fingers 13 at its front part that are separated by slots 14.

This FIG. 5 is a section along a median plane passing through two fingers 13 of the sleeve. Here, there are six fingers 13 separated by six slots 14 evenly spaced angularly. The fingers 13 incorporate a thickened front part 13*a* finished off by a flat part 10*b* perpendicular to the axis 15 of the sleeve (which is also the axis of the casing 3, the ammunition 4 and the case 2).

The fingers 13 are applied on the nose 4*c* of the projectile behind the flange ring 9. The flat part 10*b* thus forms an abutment surface preventing the ammunition from being extracted.

Thus, the sleeve 10 ensures that the inertial stresses of the ammunition 4 are taken up further to a fall in direction F. These inertial stresses are communicated by the projectile, via the sleeve 10, to the inner casing 3 and to the collar 24.

The lid 6 has a bottom shim 18 made of deformable foam itself pressing against a shim of rigid polystyrene 19 surrounded by a ring of cardboard 28. This ring is crushed by the collar 24 during a fall in direction F.

The sleeve 10 has a conical external surface 10*a* that is intended to cooperate with the internal surface of a limit stop 16.

Figure 3A:
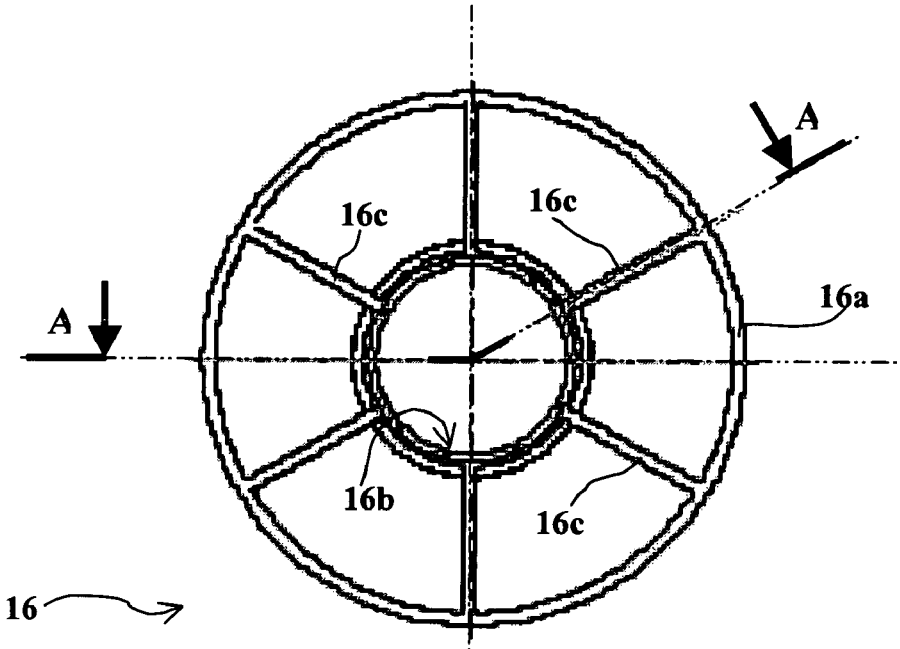
FIGS. 3*a* and 3*b* are views of the fixed limit stop alone, FIG. 3*b* being a section along the broken planes marked AA in FIG. 3*a*, FIG. 3*a* being a rear view of the limit stop.
Figure 3B:
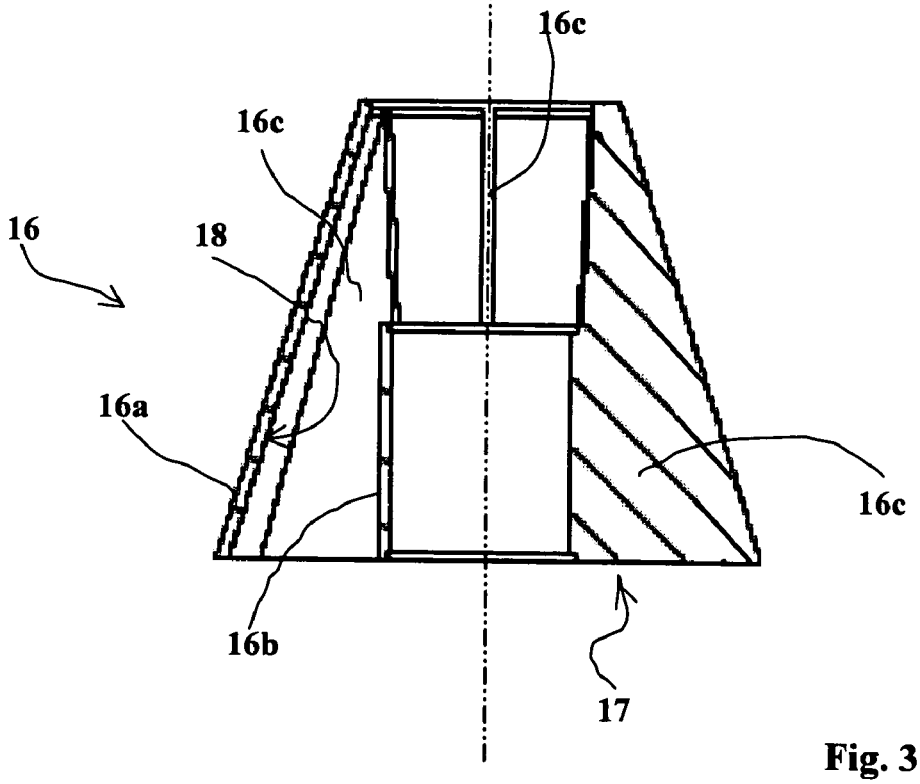
Figure 4:
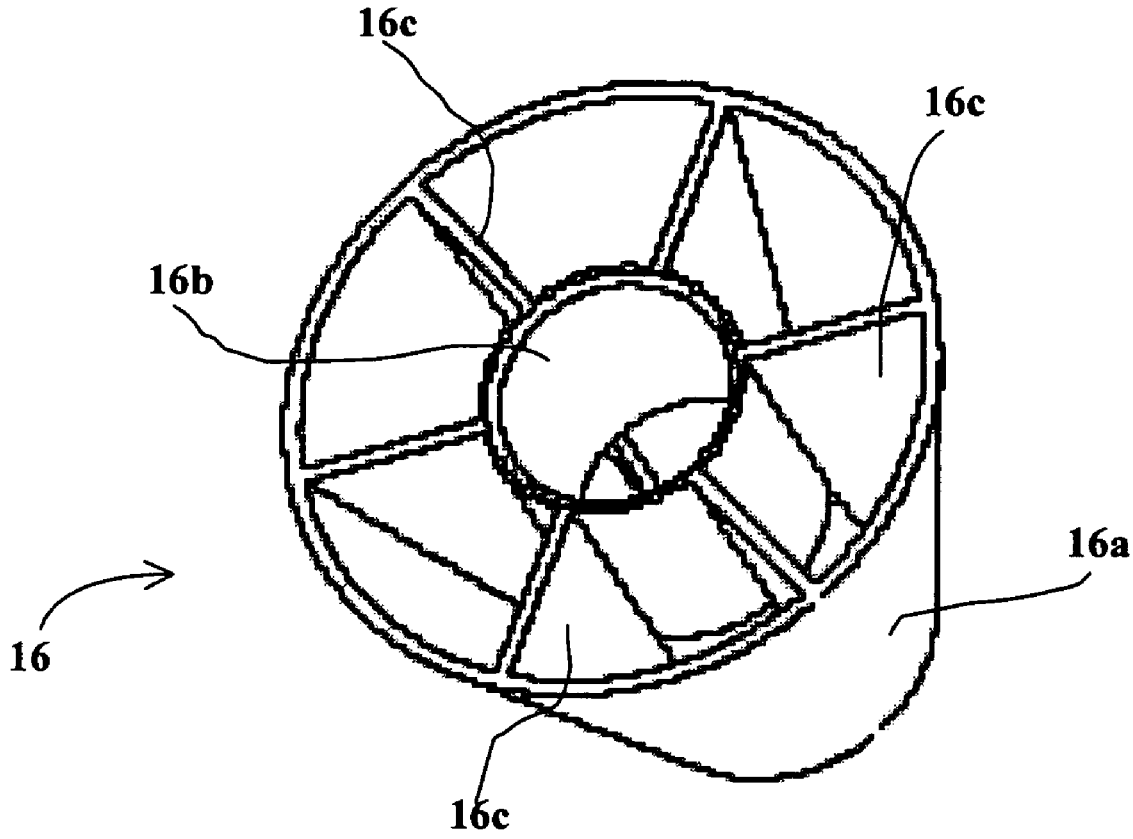
FIG. 4 is a perspective view of the fixed limit stop alone.

This limit stop 16 may be seen more particularly in FIGS. 3*a*, 3*b* and 4. It comprises a cone portion 16*a* and an internal coaxial cylinder 16*b* connected by radial ribs 16*c* (here there are six ribs 16*c* evenly spaced angularly, but only one rib is required).

The limit stop 16 is made here as a single part of plastic material. As may be more particularly seen in FIG. 3*a*, the ribs 16*c* extend axially over the full height of the limit stop 16. As will be explained hereafter, the inner cylinder 16*b* is of sufficient height to ensure sufficient opening of the sleeve 10 in its unblocking position, this in order to enable the passage of the flange ring 9 of the projectile 4*b*. The base of the inner cylinder 16*b* is in the same plane as the large base 17 of the limit stop 16.

The inner profile 18 of the limit stop is a cone with the same taper as the external surface 10*a* of the sleeve 10.

The internal cylinder 16*b* has an inner diameter enabling the passage of the collar 9 on the nose 4*c* of the projectile 4*b*.

When the container is being assembled, the slots 14 separating the fingers 13 receive the limit stop's ribs 16. The sleeve 10 thus comes into contact without hindrance with the limit stop 16 despite the presence of the internal cylinder 16*b* which is thus positioned inside the sleeve 10.

The fixed limit stop 16 is integral with a shim 20 of compressible material (for example foam) which is itself made integral with the case 2 (by bonding or stapling).

The shim 20 thus incorporates a conical inner bore 20*a* shaped so as to receive the limit stop 16. The latter is immobilized axially with respect to the shim 20 between two counter-sinks 21*a* and 21*b*. The limit stop 16 is mounted in the flexible shim 20 by being clicked into position between the counter-sinks. This is enabled by the flexibility of the material constituting the shim.

Furthermore, the shim 20 incorporates a conical profile 22 extending that of the limit stop 16 which is also applied against the external profile of the sleeve 10 in its blocking position.

When the container 1 receives a piece of ammunition 4 and is closed (position shown in FIG. 1), the sleeve 10 is in contact with the limit stop 16 (as well as with the conical profile 22). Both limit stop 16 and profile 22 thus prevent the radial opening of the fingers 13. This contact stiffens the fingers 13 by preventing them from buckling under the compressive stresses communicated by the ammunition 4. The fingers 13 thus remaining positioned behind the flange ring 9 of the ammunition 4.

During a fall of the container 1 in direction G, the body 4*b* of the projectile abuts against the sleeve 10 by its calibred front part 4*e* (FIG. 1).

The inertial stresses on the ammunition are communicated by the sleeve 10 to the limit stop 16 and the shim 20 which is crushed to absorb the shock.

Figure 2:
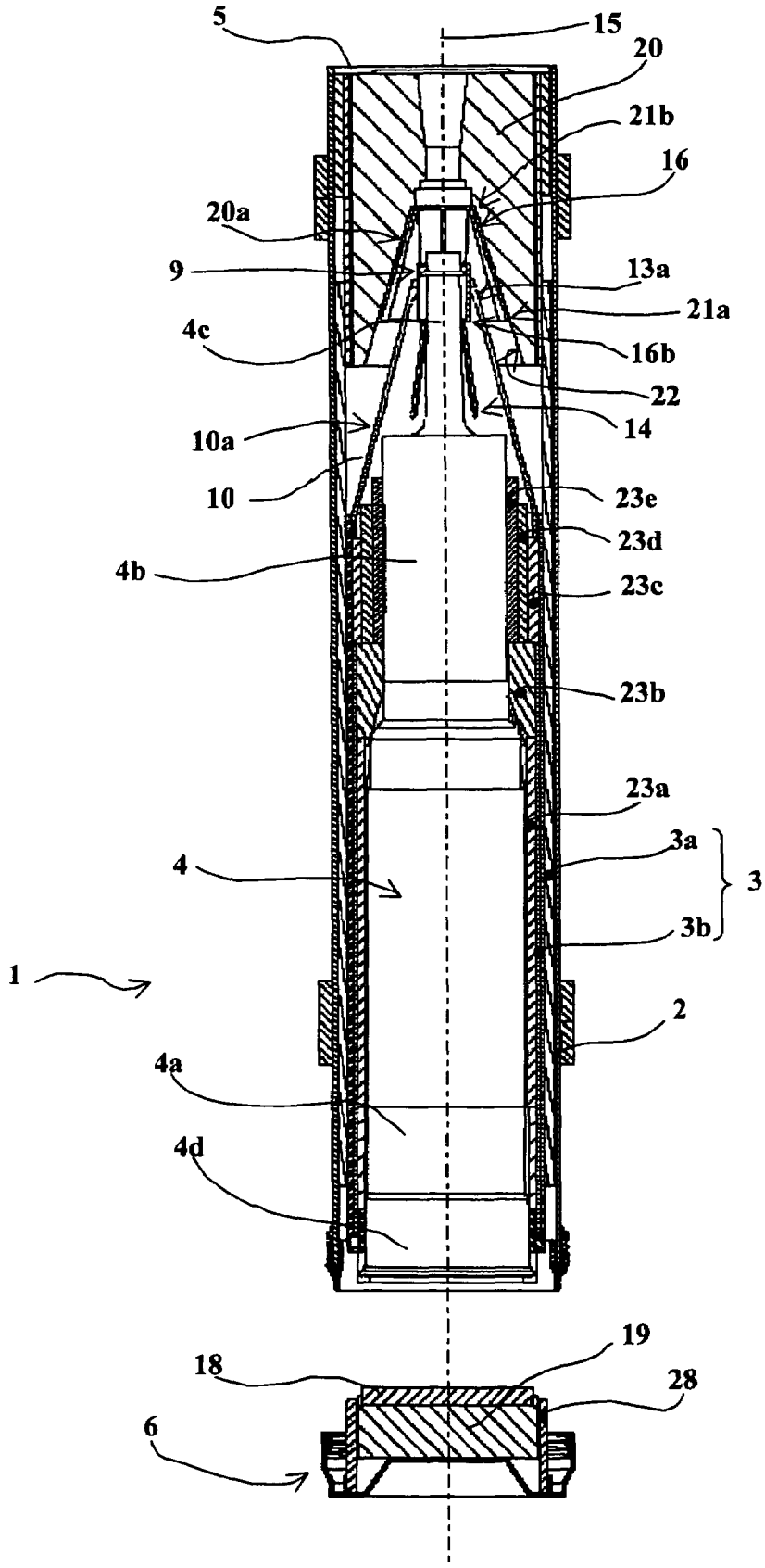
FIG. 2 is an analogous view to the previous one showing the container in the unblocking position with its lid removed.

As may be more particularly seen in FIG. 2, to remove the ammunition from the container, the inner casing 3 is made to slide towards the rear of the container. During this movement, the fingers 13 are radially spread by the internal cylinder 16*b* which remains immobile with respect to the case 2. The fingers thus allow the passage of the flange ring 9 of the ammunition 4. The ammunition is thus no longer blocked in translation and may be removed without difficulty from the container 1.

To introduce ammunition into the container, the casing 3 is also made to slide rearwards, thereby spreading the fingers 13 by means of the internal cylinder 16*b* and enabling the ammunition to be introduced.

Note that, by design, the elasticity of the fingers 13 of the sleeve 10 would enable the passage of the nose's flange ring 9 during the introduction of the ammunition (if the fingers 13 were not spread enough by the internal cylinder 16*b*).

Different variants are possible without departing from the scope of the invention. It is thus possible for a container to be defined whose sleeve is of a different shape and which is adapted to the profile of another type of projectile.

In any case, flexible fingers pressing on a zone of the projectile will be provided, the fingers being simply held in their blocking position by a fixed limit stop and spread by suitable means at a distance from the projectile in their unblocking position to allow the ammunition to be removed.

What is claimed is:

1. A container for ammunition or a projectile of the type comprising a case inside which an inner casing receiving the ammunition is able to slide between two axial positions, one position of said two positions in which said inner casing blocks said ammunition and the other of said two positions in which said inner casing unblocks said ammunition, said inner casing incorporating a front sleeve having flexible fingers, said sleeve cooperating in its blocking position with a fixed limit stop integral with said case and ensuring the retention of said fingers on a zone of said projectile to limit its translation, wherein said container incorporates means ensuring the radial spacing of said flexible fingers at a distance from said projectile in the unblocking position of said inner casing.

2. A container according to claim 1, wherein said means ensuring said radial spacing of said fingers comprise a cylinder coaxial to said inner casing and integral with said fixed limit stop.

3. A container according to claim 2, wherein said fixed limit stop incorporates a conical profile cooperating, in said blocking position, with a matching profile on said fingers of said sleeve.

4. A container according to claim 3, wherein said fixed limit stop comprises a conical portion connected to said coaxial cylinder by at least one radial rib.

5. A container according to claim 4, wherein said sleeve incorporates slots separating said fingers, said slots intended to receive said ribs on said fixed limit stop.

6. A container according to claim 3, wherein said fixed limit stop is integral with a shim made of a compressible material fixed to said case.

7. A container according to claim 6, wherein said shim of compressible material incorporates a conical profile extending the profile of said limit stop.

8. A container according to claim 1, wherein said sleeve of said inner casing surrounds one front part of said projectile, an inner surface of said sleeve forming a support for the body of said ammunition.

9. A container according to claim 8, wherein said sleeve is globally conical in shape surrounding a front part of said projectile, said sleeve extended by a seat fastened to said inner casing.

10. A container according to claim 1, wherein said container incorporates at least one cylindrical shim integral with said inner casing, said shim intended to be placed between said casing and said ammunition.

* * * * *